US005574532A

United States Patent [19]

Hagiwara et al.

[11] Patent Number: 5,574,532

[45] Date of Patent: Nov. 12, 1996

[54] AUTOMATIC DEVELOPING APPARATUS FOR SILVER HALIDE PHOTOGRAPHIC PHOTOSENSITIVE MATERIAL

[75] Inventors: Moeko Hagiwara; Tsuyoshi Haraguchi, both of Hino, Japan

[73] Assignee: Konica Corporation, Japan

[21] Appl. No.: 403,275

[22] Filed: Mar. 13, 1995

[30] Foreign Application Priority Data

Mar. 17, 1994 [JP] Japan ..... 6-047242

[51] Int. Cl.[6] ..... G03D 3/02

[52] U.S. Cl. ..... 396/626; 430/465

[58] Field of Search ..... 354/298, 324; 430/372, 373, 449, 450, 451, 455, 458, 460, 461, 468, 463–465, 430

[56] References Cited

U.S. PATENT DOCUMENTS 5,351,103 9/1994 Komatsu et al. ..... 354/324

FOREIGN PATENT DOCUMENTS 5-142708 6/1993 Japan ..... 354/324

*Primary Examiner*—D. Rutledge

*Attorney, Agent, or Firm*—Jordan B. Bierman; Bierman and Muserlian

[57] ABSTRACT

In an apparatus for processing a silver halide photographic material, processing solid agent is composed of a mixture of a plurality of processing agent components and has average particle sizes of 150 μm to 3000 μm more than 50% in particle size distribution thereof. The agent supply device measures a predetermined volume of the processing solid agent and supplies it into a processing solution with which the silver halide photographic material is processed.

10 Claims, 12 Drawing Sheets

AUTOMATIC DEVELOPING APPARATUS FOR SILVER HALIDE PHOTOGRAPHIC PHOTOSENSITIVE MATERIAL

BACKGROUND OF THE INVENTION

The present invention relates to an automatic developing apparatus for silver halide photographic photosensitive material, and more specifically, to a compact automatic developing apparatus and to an automatic developing apparatus having a solid processing agent replenishment apparatus in a photosensitive material processing apparatus in which a dissolving operation is not necessary, resulting in greatly improved operability.

Silver halide color photographic photosensitive material (hereinafter, also called photosensitive material) is processed by developing, desalting, washing, and stabilizing processes after exposure. Monochrome silver halide photographic photosensitive material is developed and fixed after exposure.

Normally, the above-described processing is carried out in an automatic developing apparatus while the photosensitive material is successively and automatically conveyed through the above-described processes.

When the photosensitive material is processed by such an automatic developing apparatus, conventionally, a method, by which processing agents are replenished to maintain a constant chemical activity of processing solutions in the processing tanks, is widely adopted.

Specifically, a processing operation is carried out while a replenishing solution is timely supplied in the processing tank from a replenishment tank.

In this case, the replenishment solution itself, stored in the replenishment tank, is generally prepared in a different location. In mini-laboratories, the number of which has greatly increased recently, when the replenishment solution in the replenishment tank, usually placed quite close to the automatic developing apparatus, has been used up, a predetermined amount of the replenishment solution is normally prepared at a time. When the replenishment solution is prepared, the solid processing agent is manually dissolved, or automatically dissolved with a mixer.

Commonly, a processing agent for silver halide photographic photosensitive material (referred to as a photographic processing agent in this specification hereinafter) is put on the market in the form of powder or condensed liquid. When it is put into practical use, powder is manually dissolved in a predetermined amount of water in the case of powder, and in the case of a condensed liquid, a predetermined amount of water is added to the condensed liquid, and then the mixture is manually stirred and appropriately diluted. In this way, the replenishment solution is prepared.

When the replenishment solution is prepared in the manner described above, it takes time to dissolve the solid processing agent. While the preparation work is being carried out, the solid processing agent is usually not yet completely dissolved in the solution. Therefore, in order to prevent replenishment solution, the concentration of which varies greatly from a predetermined value, from being fed to the processing tank in the mini-laboratory, it is necessary to stop feeding the replenishment solution.

In general, continuous processing of photosensitive material is temporarily stopped, and after the replenishment solution has been prepared, the operation is re-started. For this reason, the efficiency of continuous processing of photosensitive material is greatly lowered.

From the viewpoint of protecting the natural environment, solidification of photographic processing agents have been developed recently. For example, solidified photographic processing agents are disclosed in Japanese Patent Publication Open to Public Inspection Nos. 109042/1990, 109043/1990. 39379/1991, 39735/1991, 19655/1992 and 230748/1992.

However, in the case where the replenishment solution prepared from the above solid processing agents, the dissolution time of the solid processing agent is longer than the dissolution time of the liquid processing agent. Accordingly, the continuous processing operation is stopped for a long period of time, which greatly reduces the work efficiency. Therefore, it is desired to solve the above problems.

Recently, with the increased concern for our natural environment, it is required to decrease the amount of photographic processing waste solutions. As a part of technologies to meet the above requirement, technologies in which the stabilizer solution is fed to the fixer solution or bleach-fix solution in order to decrease the entire amount of waste solutions, have been proposed in Japanese Patent Publication Open to Public Inspection Nos. 14834/1983, 3448/1983, 235133/1985, and 212935/1988.

However, in all of these technologies, use of kits of liquid processing agents are premised. Liquid processing agent kits have the following disadvantages.

(1) Concentration of the solution can not exceed that corresponding to the solubility of the replenishment solution (because crystals are crystalized when the concentration exceeds the solubility), and therefore rapid processing and small amount of replenishment are limited.

(2) Dissolving and mixing of the replenishment solution is complicated and troublesome.

(3) It is relatively dangerous to transport and handle liquid processing agents.

(4) (Complete) Automation of replenishment of the condensed solution kits is difficult for manual dissolving operations.

(5) Because many replenishment tanks are provided in the automatic developing apparatus, it is difficult to reduce the size of the automatic developing apparatus.

(6) When liquid replenishment solution is stored for a long period of time, components in the solution deteriorate.

(7) Because plastic resin bottles are used for the liquid, they contribute to environmental pollution when they are discarded.

In order to solve the problems of liquid processing agents, Japanese Patent Publication Open to Public Inspection Nos. 119454/1993 and 188533/1993 disclose methods by which a solid processing agent is directly charged into the processing tank. However, even when the above technique is applied, it is difficult to stably and accurately replenish a predetermined amount of the solid processing agent.

In the case where a predetermined amount of granular, powdery or pellet-shaped solid processing agent is measured and replenished, when errors are caused in the replenishment amount of solid processing agents, it is difficult to stably process photosensitive material. Accordingly, it is required to accurately replenish the solid processing agent.

Generally, when granular or powdery solid processing agents are measured at the time of replenishment, volumes are measured normally, and the replenishment apparatus is relatively inexpensive. However, in the case of solid processing agents for processing silver halide photographic photosensitive material, a method, in which components are divided into a plurality of parts, a plurality of types of granules, powders and pellets are prepared, and they are respectively supplied independently, because of the storage stability, is widely known (Japanese Utility Model Open to Public Inspection No. 179729/1989, and others). However, in this replenishment apparatus, a plurality of replenishment apparatus are necessary for each processing tank, and a supply control means is necessary for each replenishment apparatus. Accordingly, the mechanism becomes more complicated and expensive. Further, the automatic processing apparatus, in which the replenishment apparatus are included, becomes larger because the space for the replenishment apparatus is increased, which is a disadvantage of the above technology.

Accordingly, it is advantageous to prepare mixtures of a plurality of types of granular or powder and to measure and supply a predetermined amount of the mixtures from a mixture container. In this connection, when the above mixture is measured and supplied, the interaction occurs between granules themselves or powder themselves, and blocking easily occurs. Specifically, under highly humid circumstances as is common in the automatic developing apparatus, this phenomenon is emphasized and supply failures easily occur.

In order to avoid the above problems, there is a supply method, in which a predetermined amount of solid processing agents such as granules or powders are packed into a film sheet bag in order to prevent humidity. However, there are following problems. The bag can often not be accurately opened; remaining solid processing agents scatter in the bag; disposal of the used bag is problematic; and conveyance mechanisms, by which the bag is opened and conveyed, become complicated.

SUMMARY OF THE INVENTION

In order to solve the above problems, the present inventors conducted various investigations. It is an objective of the present invention to provide an improved solid processing agent replenishment apparatus capable of providing the following effects.

(1) The problems of accumulated replenishment errors are solved, and a processing solution of a stable composition is provided.

(2) Even when deviations of shape, volume, weight and composition of solid processing agents are caused by environmental humidity, blocking does not occur and the solid processing agent can be accurately measured.

(3) It is not necessary to provide a complicated and precise replenishment apparatus, and the solid processing agent can be stably replenished using an inexpensive replenishment apparatus.

The present inventors have found that the above problems are solved by the following composition.

The above objective can be attained by an automatic developing apparatus for a silver halide photographic photosensitive material as follows. An automatic developing apparatus for a silver halide photographic photosensitive material has a measuring means for measuring solid processing agents of a predetermined amount and for automatically supplying it into a processing solution in a processing tank provided in the automatic developing apparatus or into a processing solution in a portion connected to the processing tank. In the above apparatus, the measuring means measures a predetermined volume of solid processing agents. The average particle size of the solid processing agent is 150 μm through 3000 μm. A plurality of types of components of processing agents are collectively mixed. Further, at least 50% of the solid processing agents with the average particle size is included in the particle size distribution of the solid processing agents.

Concerning the solid processing agents used in the present invention, a predetermined amount of the solid processing agents is packed in a container so that it is formed into one unit. A predetermined amount of the solid processing agents is measured and packed in a container in a manufacturing factory, and replenishment control is conducted in such a manner that the solid processing agent is divided into a plurality of portions and each portion is charged into the processing tank. In the present invention, any of powdered, granular, tablet-shaped and pellet-shaped solid processing agents can be used, and even when they are mixed with each other, no problems occur. In the case of the processing solution such as water, which is not dangerous, even when a liquid type processing agent is applied together with the solid processing agents, the objective of the present invention can be accomplished. In the case of granular or powdery processing agents, it is preferable that a predetermined amount of the processing agents is packed with an alkaline soluble, film, plastic film or paper so that only one set of the solid processing agent is provided.

DETAILED DESCRIPTION OF THE PREFERRED EMBODIMENT

Figure 1:
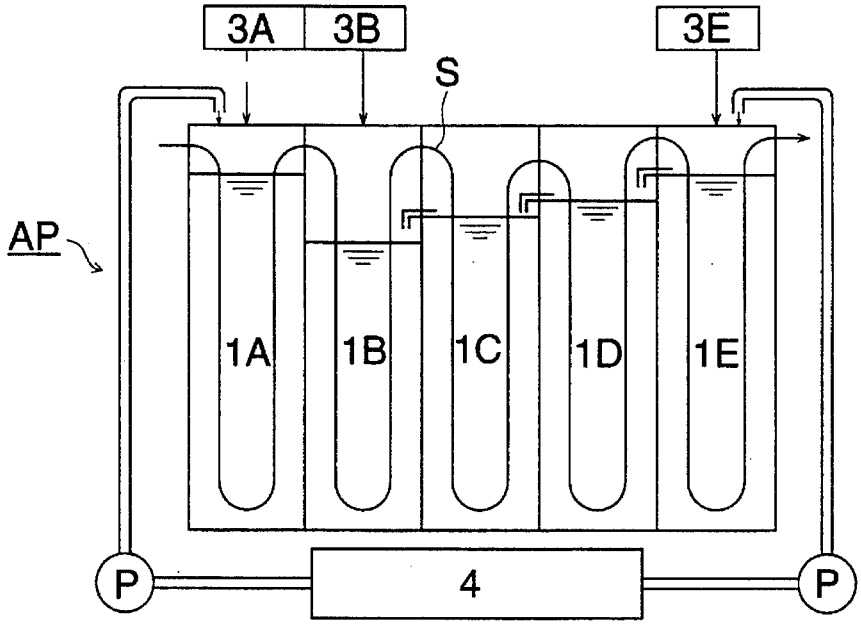
FIGS. 1(A) and 1(B) are overall arrangement views of the automatic developing apparatus.
Figure 1:
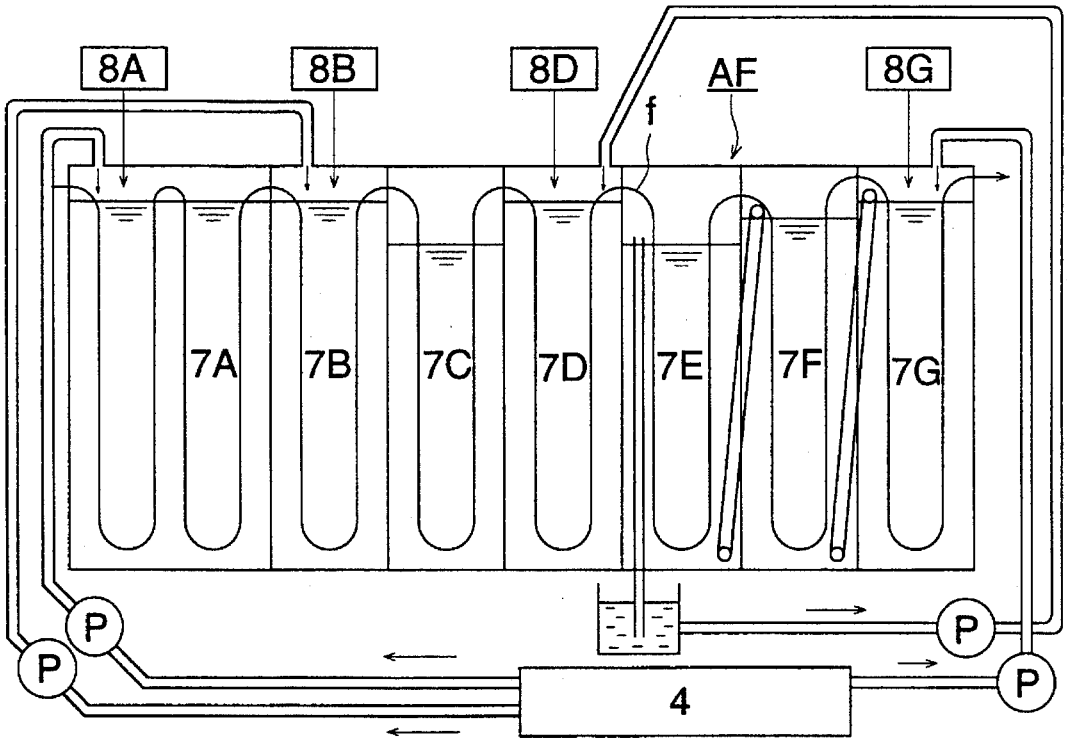

FIG. 1(A) is an arrangement view of the automatic developing apparatus AP for developing sheet-shaped photographic paper. In the automatic developing apparatus AP, the sheet-shaped photographic paper "pa" is processed by the processing solutions in the color developing tank 1A, bleaching and fixing tank 1B, and stabilization tanks 1C, 1D, 1E. After the processing has been completed, the sheet-shaped photographic paper "pa" is dried. As illustrated in FIG. 1(A), the liquid levels of the stabilization tanks 1C, 1D and 1E are successively higher than the liquid level of the bleaching and fixing tank 1B. Consequently, the solution which overflowed the tank 1E flows into the tanks 1D, 1C, 1B by the action of gravity, so that the apparatus is formed into a counter-current system.

FIG. 1(B) is an arrangement view of the automatic developing apparatus AF for developing negative photographic film. In the automatic developing apparatus AF, the negative photographic film "f" is processed by the solutions in the color developing tank 7A, bleaching tank 7B, fixing tanks 7C, 7D, and stabilization tanks 7E, 7F, 7G. After which the negative photographic film "f" is dried. The solid processing agent supply apparatus 8A, 8B, 8D, 8G are respectively attached to the color developing tank 7A, bleaching tank 7B, fixing tank 7D and stabilization tank 7G. In this connection, the replenishment water tank 4 is constructed in the same manner as that shown in FIG. 1(A), so that the same reference numeral is attached to it.

Because effective components in a pre-bath processing solution tank which have been brought out when the photosensitive material is processed are also included in the overflow solution, when the solution that has overflowed the processing tank is utilized as the replenishment water for the pre-bath processing solution tank of the processing solution tank, the required amount of the solid processing agents can be decreased, and the amount of replenishment water for the processing solution tank can also be decreased, which are effects of the present invention.

In this specification, powder is defined as an aggregation of fine crystals. In this specification, granules are made when such powder is subjected to a granulation treatment, and the particle size is in a range of 50 to 5000 μm. However, in order to fully exhibit the effects of the present invention, the average particle size of granules preferably ranges from 150 μm to 1500 μm, and further, it is necessary to include the solid processing agents, having the particle size of 150 μm through 1500 μm, more than 50% in the particle size distribution. When there is much fine powder, having a particle size of less than 50 μm, blinding easily occurs in the charging apparatus, resulting in charging errors. Further, the fine powder is easily affected by humidity, and when humidified fine powder adheres to a slightly larger particle, blocking easily occurs. Further, in the case of photographic developing processing agents, there are acid granules such as color developing agents and alkaline granules. In cases where these granules are mixed, the contact surface is increased as the particle size is decreased, and blocking is caused by chemical reaction, resulting in charging errors. Further, tar is easily generated, coloring easily occurs, and finally, components are decreased and the developability is greatly affected thereby.

On the other hand, when there are many particles having the particle size of more than 5000 μm, the gap between particles increases and errors are easily caused. Specifically, in the case of granules which are made by granulation, when the particle size is larger, the granules are more easily collapsed, granules close to a base portion of the package are collapsed, and fine powder is more easily generated. When much fine powder is generated, errors due to blocking or blinding are caused. Further, the fine powder is scattered in the air, and adheres to eyes or skin, which is not preferable also in safety conditions. Tablets in the present invention mean developing agents in which powder or granules are compression-formed into predetermined-shape tablets.

When granules are prepared, it is more preferable that the granulation is independently conducted for each component such as an alkaline agent, reducing agent, bleaching agent and preservatives.

The granular type solid processing agent can be manufactured by common methods disclosed in Japanese Patent Publication Open to Public Inspection Nos. 109042/1990, 109043/1990, 39735/1991 and 39739/1991. Further, the powder type processing agent can be manufactured by common methods disclosed in Japanese Patent Publication Open to Public Inspection Nos. 133332/1979, British Patent Publication Nos. 725,892 and 729,862 and German Patent Publication No. 3,733,861.

From the viewpoints of improving the solubility and enhancing the effect of the present invention, it is preferable that the bulk density of the solid processing agent is 1.0 to 2.5 g/cm$^3$. In order to enhance the mechanical strength of the solid processing agent, it is preferable that the bulk density is higher than 1.0 g/cm$^3$, and in order to enhance the solubility of the solid processing agent, it is preferable that the bulk density is lower than 2.5 g/cm$^3$. In the case where the solid processing agent is composed of granules or powder, it is preferable that the bulk density is 0.40 to 0.95 g/cm$^3$.

TABLE 1

| | One package unit | | Charging amount (cm$^3$) per one charging | Theoretical charging frequency | Throughput (m$^2$) of color paper per one charging |
|---|---|---|---|---|---|
| | Weight | Volume | operation | (times) | operation |
| Color developer replenishment agent | 500 g | 600 cm$^3$ | 10 | 60 | 1 |
| Bleach-fix replenishment agent | 500 g | 650 cm$^3$ | 26 | 25 | 1 |
| Stabilizater replenishment agent | 250 g | 300 cm$^3$ | 2 | 150 | 1 |

Granular solid processing agents for silver halide photographic photosensitive material development according to the present invention, collectively include, at least, alkaline agents and developing agents. A specific volume of the solid processing agent is 0.6 through 2.0 cm3/g, and a water content ratio of the solid processing agent is 0.1 through 15 wt %. At least a portion of the solid processing agents is made by granulation. The solid processing agents include the alkaline agents and developing agents as independent component parts. Alternatively, the solid processing agents are made by granulation, in which component parts include at least either the alkaline agents or developing agents. Further, alternatively, the solid processing agents are made by granulation, in which a portion of component parts includes alkaline agents and other portions of the component parts include developing agents. The average particle size of the granular agents, made by granulation, is in the range of 150 to 1500 μm.

In the developing solid processing agents collectively including the alkaline agents and developing agents, when the water content ratio of the developing solid processing agents exceeds 15 wt %, reaction due to contact between the alkaline agents with the developing agents occur depending on the water content, and thereby blocking occurs, resulting in errors in charging. Further, the developing agents are oxidized, or unstabilized, and it is difficult to maintain the content of the developing agent at a predetermined value. Reversely, when the water content ratio is not larger than 0.1 wt %, the bonding strength of particles is lowered, the processing agent is pulverized, and thereby, powder is generated.

When the specific volume of the solid processing agents exceeds 2.0 $cm^3/g$, space in the solid processing agents becomes larger, resulting in errors. Accompanying this, it is considered that the amount of water absorbed in the solid processing agents is increased. In this case, it was found that the developing agents are further oxidized, and the developing agent content in the solid processing agents is decreased. Reversely, when the specific volume of the solid processing agents is not larger than 0.6 $cm^3/g$, the contact surface of reactive components is increased, resulting in blocking. Further, when the processing agents are stored for a long period of time, coloring occurs in the solid processing agents.

The present inventors investigated the above experimental results, and found the following. In the solid processing agents for silver halide photographic photosensitive material development, when the specific volume of the solid processing agents is 0.6 through 2.0 $cm^3/g$, the water content ratio is 0.1 through 15 wt %, and at least a portion of the solid processing agents is made by granulation, no blocking occurs, and charging errors are greatly reduced. Accordingly, the solid processing agents can be stably charged, and the solid processing agents for silver halide photographic photosensitive material, which is stable and has a sufficiently long shelf life, can be provided.

The water content of the solid processing agents is preferably within the range of 0.1 through 15 wt %. In view of resulting effects, it is more preferably within the range of 0.3 through 10 wt %, and still more preferably within the range of 1 through 8%. The specific volume of fine granular solid processing agents is preferably within the range of 0.6 through 2.0 $cm^3/g$, and in view of the desired effects, it is more preferably within the range of 0.8 through 1.5 $cm^3/g$.

The water content ratio in this specification is defined as follows. A commercial electronic moisture meter is used; the solid processing agent is heated at 105 ° C. until its weight becomes constant; the decreased weight is found; this decreased weight is calculated as the included amount of water; and the water content ratio is calculated from this included amount of water. The specific volume in this specification is defined as follows. A test sample of 10 g is slowly added into a commercial graduated cylinder for 25 ml and the volume is measured; and the specific volume is found by the following equation.

(the specific volume)=(volume)/(weight)

The developing solid processing agents collectively include at least one kind of alkaline agent and at least one kind of developing agent. These solid processing agents may be a mixture in which solid material is simply mixed, or may be a mixture in which agents, made by granulation after several kinds of powdery solid material have been mixed, are mixed.

In the developing solid processing agents, in order to further exhibit the desired effects, it is preferable that the alkaline agents are in contact with the developing agents as little as possible. From this point, when at least one of the alkaline agents and developing agents exist, the effects of the present invention can be more clearly realized, which is more preferable. Further, it is still more preferable that both the alkaline agents and developing agents are granular. This is for the following reason. When at least one of the alkaline agents and developing agents is granular, the generation of fine powder is further decreased during storage of the solid processing agents, which is another desired effect of the present invention in addition to the foregoing effects.

The following manufacturing methods can be used for granular particles: rolling granulation; extrusion granulation; compression granulation; cracking granulation; mixing granulation; fluid bed granulation; and spray drying granulation, etc., which are obvious to skilled persons.

The average particle size of granular particles of respective alkaline agents and developing agents is preferably within the range of 150 through 1500 μm, and more within the range of 300 through 1000 μm.

The developing agent of the present invention may be either a color developing agent or a black-and-white developing agent.

The color developing agent is preferably a p-phenylene diamine type compound having a water-soluble group.

In the p-phenylene diamine type compound having a water-soluble group, at least one water-soluble group is positioned on the amino group or benzene nucleus of a p-phenylene diamine type compound. The typical water-soluble groups include preferably $—(CH_2)_n—CH_2OH—$, $—(CH_2)_m—NHSO_2—(CH_2)_n—CH_3$, $—(CH_2)_m—O—(CH_2)_n—CH_3$, $—(CH_2CH_2O)_nC_mH_{2m+1}$ (in which m and n are each an integer of not less than 0), —COOH group and $—SO_3H$ group.

The example of the color developing agent preferably used in the invention, includes (C-1) through (C-16) and 4-amino-3-methyl-N-(3-hydroxypropyl)aniline on pages 26 to 31 of Japanese Patent Application No. 2-203169/1990 (refer to Japanese Patent Publication Open to Public Inspection No. 86741/1992). The above color developing agents are usually used in the form of hydrochloride, sulfate or p-toluenesulfonic acid salt. Of these, 4-amino-3-methyl-N-ethyl-N-(β-methanesulfonamidoethyl)aniline 3/2 sulfate monohydrate (CD-3) and 4-amino-3-methyl-N-ethyl-N-(βhydroxyethyl)aniline sulfate (CD-4) are preferable for the photographic film.

The example of the black-and-white developing agent includes phenidone, hydroquinone, metol, 4-hydroxymethyl-4-methyl-1-phenyl-3-pyrazolidone, 4,4-dimethyl-1-phenyl-3-pyrazolidone and hydroquinone monosulfonic acid.

The alkali agent of the invention is a compound giving pH 8 or more in its aqueous solution. The preferable example includes sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate. (borax), potassium tetraborate, potassium hydroxide, sodium hydroxide and lithium hydroxide. Sodium carbonate, sodium bicarbonate, sodium borate and trisodium phosphate are preferable in view of moisture prevention, and sodium carbonate is especially preferable.

The solid processing agent is in the form of powder, granules or tablets, and preferably in the form of granules or tablets in attaining the objects of the present invention.

When the solid processing agent of the invention is granules, the granules have an average particle size of 150 to 1500 μm, and the mixture of the solid processing agents containing the granules in an amount of not less than 50% is preferable. As far as the above condition is satisfied, the processing agent of the present invention may contain solid powder of an average particle size of not more than 100 μm.

In the invention, it is especially preferable that the alkali agent and the developing agent both are granules. Additives in the processing agents other than the alkali agent and the developing agent may be powder.

The processing agent may optionally contain a chelating agent, a development accelerating agent, a development inhibitor (halides), a fluorescent brightening agent or a preservative usually used in the developer of the processing agent for silver halide photographic photosensitive material.

A solid preservative is preferably used in combination in the solid processing agents of the present invention, and granules of a mixture of a preservative and a developing agent are preferable for the granules containing developing agents.

The preservative includes a sulfite (sodium sulfite or potassium sulfite), a bisulfite (sodium bisulfite or potassium bisulfite), a metabisulfite (sodium metabisulfite or potassium metabisulfite) and a hydroxylamine derivative.

In the solid processing agents in the present invention, it is included in the range of the present invention that only a portion of components is solid. However, it is preferable that all components of the processing agents are solid. Each component is preferably molded as an independent solid processing agent, and it is packed into the same package. Further, it is also included in the range of the present invention that the components are individually packed in respective packages according to the periodic charging sequence.

In the present invention, it is preferable that all the processing agents to be replenished into each processing solution tank corresponding to throughput information, are solid processing agents. When water supply is required, water is supplied according to throughput information or other water supply control information. In this case, the liquid to be replenished into the processing solution tank, can be only supplying water. In the present invention, the supplying water means the processing solution used in the portion next to the fixing processing solution tank, or overflow-waste water. Further, it is preferable in realizing a compact automatic developing apparatus that a water tank is provided in the automatic developing apparatus.

EXAMPLES

With reference to the accompanying drawings, an example of the present invention will be explained as follows. However, the present invention is not limited to these examples.

An automatic developing apparatus (referred to as AP in this specification hereinafter) to which the present invention is applied will be explained with reference to the accompanying drawings. FIG. 2(A) is an overall arrangement view showing the construction of a silver halide photographic photosensitive material processing apparatus (printer processor) in which the automatic developing apparatus AP and photographic printer B are integrated into one body.

In FIG. 2(A), in the lower left portion of the photographic printer B, there is provided a magazine M in which a roll of photographic paper (color paper), which is an unexposed silver halide photographic photosensitive material, is accommodated. The photographic paper P is pulled out from the magazine M and conveyed by the feed rollers R1 and cut into a predetermined size by the cutter Ct. In this way, a sheet of photographic paper P can be provided. This sheet of photographic paper P is conveyed by the belt conveyance means Be. Then an image of the original O is exposed onto the sheet of photographic paper P by a light source and lens L in the exposure section E. The exposed sheet of photographic paper P is further conveyed by a plurality of pairs of feed rollers R2, R3 and R4, so that the sheet of photographic paper P is introduced into the automatic developing apparatus AP. In the automatic developing apparatus AP, the sheet of photographic paper S is successively conveyed by a roller conveyance means (a reference numeral is not attached to the means) into the color development tank 1A, bleach-fix tank 1B and stabilizing tanks 1C, 1D, 1E, wherein these tanks substantially compose a processing tank 1. Due to the foregoing, the sheet of exposed photographic paper P is subjected to color development, bleach-fix processing and stabilizing processing. After the processing has been completed, the sheet of photographic paper P is dried by the drying section 6, and then discharged outside of the apparatus.

In this connection, the one-dotted chain line in the drawing shows a conveyance passage of the photographic paper P. In this example, the photographic paper P is cut into a sheet and introduced into the automatic developing apparatus AP, however, a strip-shaped photographic paper may also be introduced into the automatic developing apparatus AP.

The automatic developing apparatus AP of the present invention may be constructed integrally with the photographic printer B, or alternatively, the automatic developing apparatus AP of the present invention may be constructed separately from the photographic printer B. The explanation of the present invention is made under the condition that the automatic developing apparatus AP includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic developing apparatus having four tanks: a color developing tank, a bleaching tank, a fixing tank and a stabilizing tank. Further, the present invention can be applied to an automatic developing apparatus AP (shown in FIGS. 4 and 5) having more processing solution tanks than those described above.

FIG. 2(B) is an arrangement plan view of the automatic developing apparatus AP. In the color developing tank 1A, the bleach-fix tank 1B and the stabilizing tank 1E, there are provided dissolution tanks 2A, 2B, 2E, circulation tanks 2C, 2D and solid processing agent replenishment apparatus 3A, 3B, 3E for supplying the solid processing agent. Reference numeral 4 is a replenishment water tank for supplying replenishment water to the color developing tank 1A and the stabilizing tank 1E.

Figure 2:
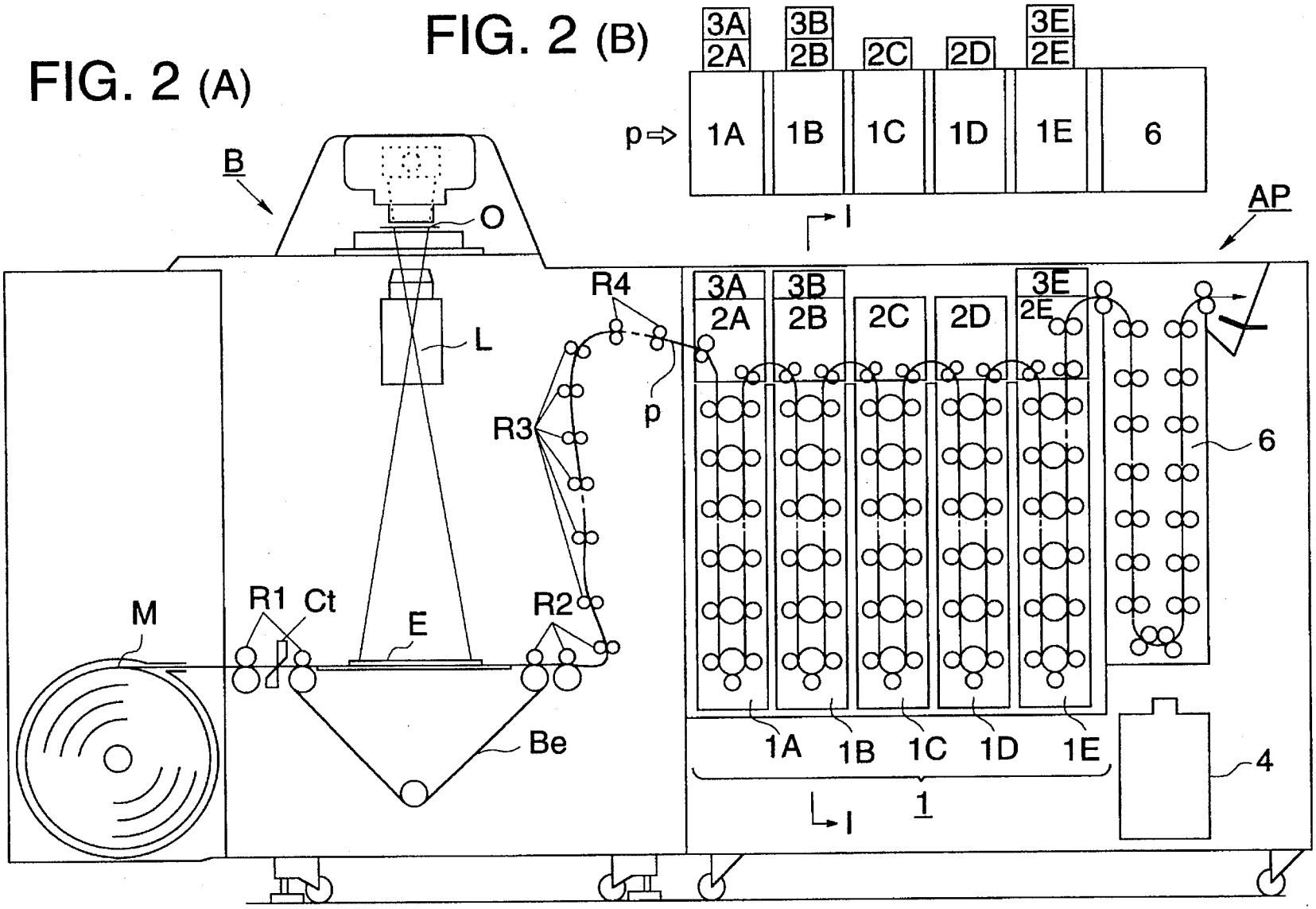
FIGS. 2(A) and 2(B) are overall arrangement views of the silver halide photosensitive material processing apparatus.
Figure 3:
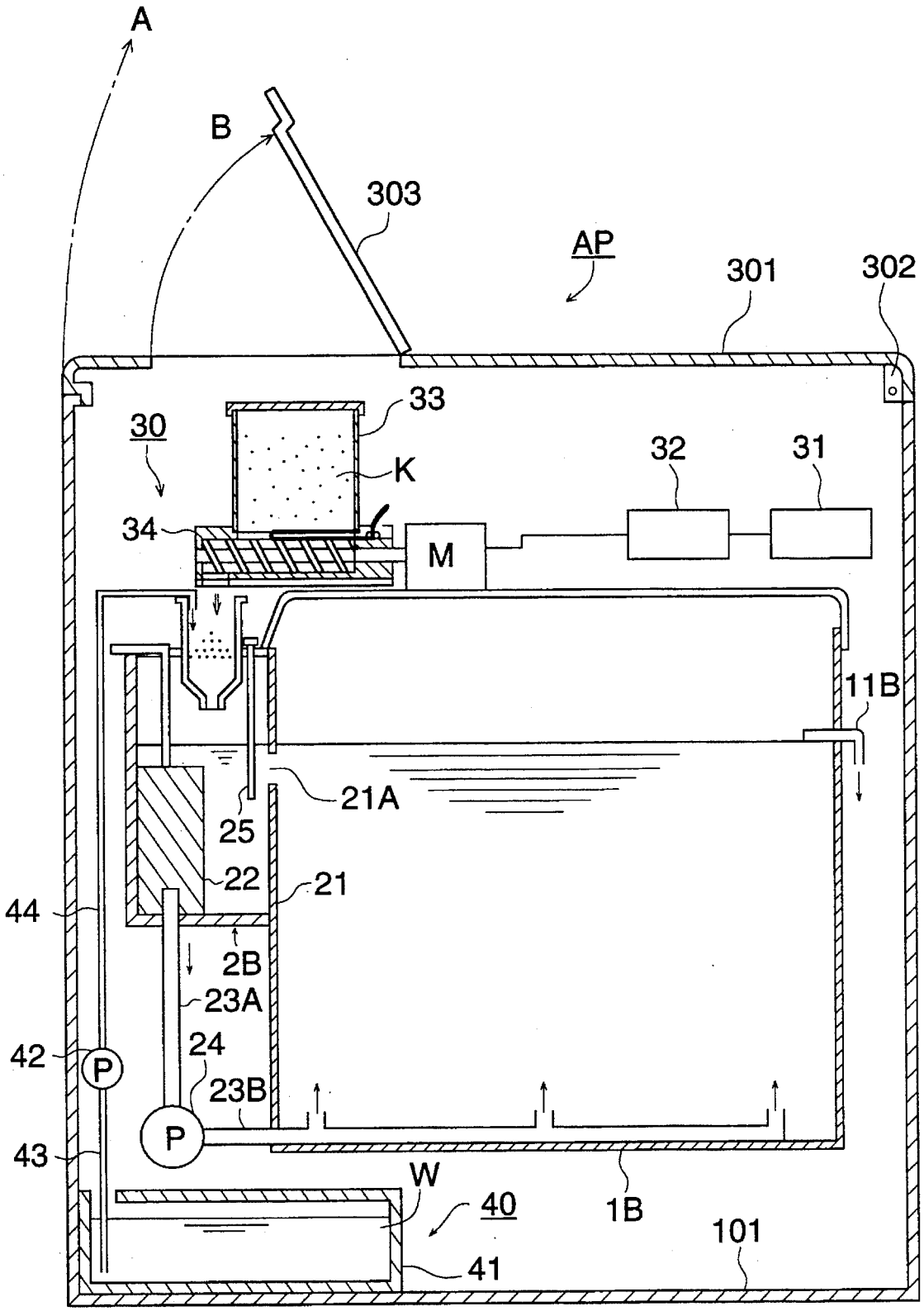
FIG. 3 is a sectional view of the automatic developing apparatus of the present invention.

FIG. 3 is a sectional view of the processing agent charging section and processing agent supply means of the bleaching and fixing tank 1B taken on line I—I in FIG. 2, showing the automatic developing apparatus AP. In this connection, to enhance the understanding of the invention, the conveyance means for conveying the photosensitive material is omitted in the drawing. In this example, explanations will be made under the condition that granular type solid processing agent K is used as the solid processing agent.

The bleach-fix tank 1B for processing photosensitive material is provided with a dissolution tank 2B integrally attached to the outside of the partition wall 21 which composes the bleaching and fixing tank 1B. The bleach-fix tank 1B and the dissolution tank 2B are separated from each other by the partition wall 21 on which a communication hole 21A is formed. Therefore, the processing solution (bleach-fix solution) is communicated through the communication hole 21A.

A cylindrical filter 22 is disposed in the dissolution tank 2B in such a manner that the cylindrical filter 22 can be replaced. The cylindrical filter 22 removes impurities in the processing solution. A circulation pipe 23A connected to the suction side of a circulation pump 24 (circulation means) is inserted into the filter 22 passing through the lower wall of the dissolution tank 2B.

The circulation system includes the circulation pipes 23A, 23B forming a circulation passage of the processing solution, and also includes the circulation pump 24. One end of the circulation pipe 23B is communicated with the delivery side of the circulation pump 24, and the other end penetrates an outer wall of the bleach-fix tank 1B, so that the circulation pipe 23B is communicated with the bleaching and fixing tank 1B. Due to the foregoing construction, when the circulation pump 24 is operated, the processing solution is sucked from the dissolution tank 2B and discharged into the bleaching and fixing tank 1B, so that the discharged processing solution is mixed with the processing solution in the bleaching and fixing tank 1B, and then sent to the dissolution tank 2B. In this way, the processing solution is circulated. The circulating direction of the processing agent is not limited to the direction shown in FIG. 3, but the direction may be reversed to that shown in FIG. 3.

A waste solution pipe 11B is provided for permitting the processing solution in the bleaching and fixing tank 1B to overflow, so the solution level can be constantly maintained and an increase in the amount of components conveyed with the photosensitive material from other tanks into the bleaching and fixing tank 1B can be prevented. Further, an accumulation of the amount of components oozing out from the photosensitive material can be prevented.

A rod-shaped heater 25 penetrates an upper wall of the dissolution tank 2B, and is dipped in the processing solution in the dissolution tank 2B. The processing solution in the dissolution tank 2B and bleach-fix tank 1B is heated by this heater 25. In other words, the heater 25 is a temperature regulating means for regulating the temperature of the processing solution in the bleach-fix tank 1B, so that the temperature can be controlled to be maintained in an appropriate range, for example, in a range from 20° to 55° C.

A replenishing means for supplying a replenishing solution into the dissolution tank 2B includes a solid processing agent supply means 30 and a replenishing water supply means 40.

A throughput information detecting means 31 is disposed at the entrance of the automatic developing apparatus AP from which the photosensitive material is conveyed, and detects the throughput of the photosensitive material to be processed. This throughput information detecting means 31 is comprised of a plurality of detecting members that are disposed in a transverse direction. This throughput information detecting means 31 detects the width of the photosensitive material, and the result of the detection is used for counting the detection time. Since the conveyance speed of photosensitive material is previously mechanically set, the throughput of photosensitive material, that is, the area of processed photosensitive material can be calculated from the width and time information. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor shown in FIG. 2, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. It is not necessary to provide the throughput information detecting means 31 for each of processing tanks 1A, 1B, 1C, 1D, 1E, and it is preferable that one throughput information detecting means 31 is provided for one automatic developing apparatus AP. The supply control means 32 includes: a processing agent supply control means for controlling the supply of solid processing solution in accordance with a signal sent from the throughput information detecting means 31; and a replenishment water supply control means for controlling the supply amount of replenishment water.

The solid processing agent replenishment apparatus 30 used for the photosensitive material processing apparatus of the present invention includes: an accommodating container 33 for accommodating the granular type solid processing agent K; a replenishment apparatus main body 34 which is a supply means; a motor M; and a drive means. The upper cover 301 of the automatic developing apparatus AP is rotatably connected with a main body 101 accommodating the bleach-fix tank 1B and the dissolution tank 2B, through a support shaft 302 attached to the back of the main body. The upper cover 301 is lifted upward as shown by a one-dotted chain line in FIG. 3, so that the front and upper portions of the apparatus can be opened widely. In this way, inspection of the solid processing agent replenishment apparatus 30, and replacement of the filter 22 can be easily conducted.

A cover 303 is rotatably connected with a portion of the upper surface of the upper cover 301. When the cover 303 is opened as illustrated by a one-dotted chain line B in the drawing, the solid processing agent K is replenished into the accommodating container 33.

Figure 4:
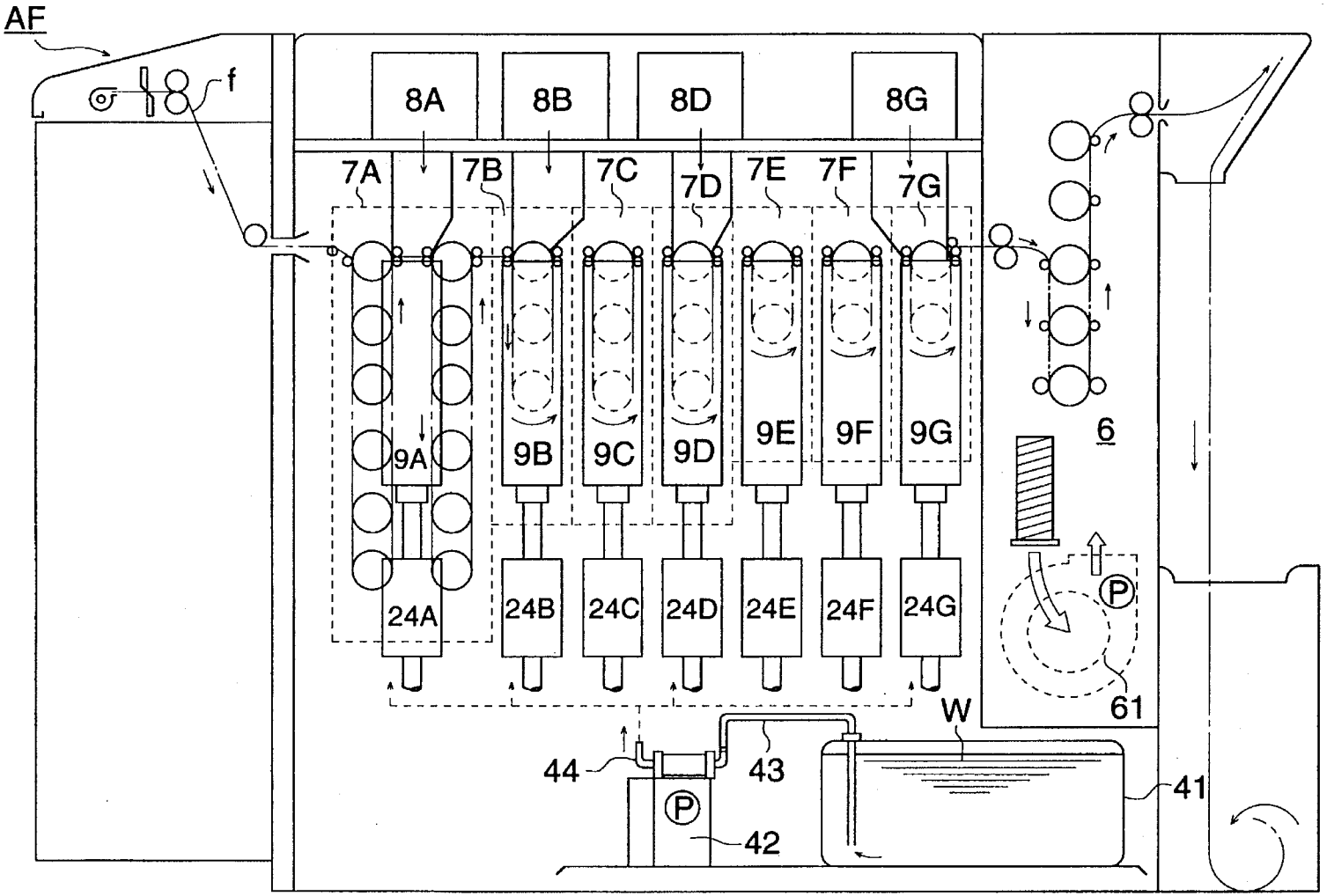
FIG. 4 is a frontal overall arrangement view of the automatic developing apparatus for developing negative photographic film.
Figure 5:
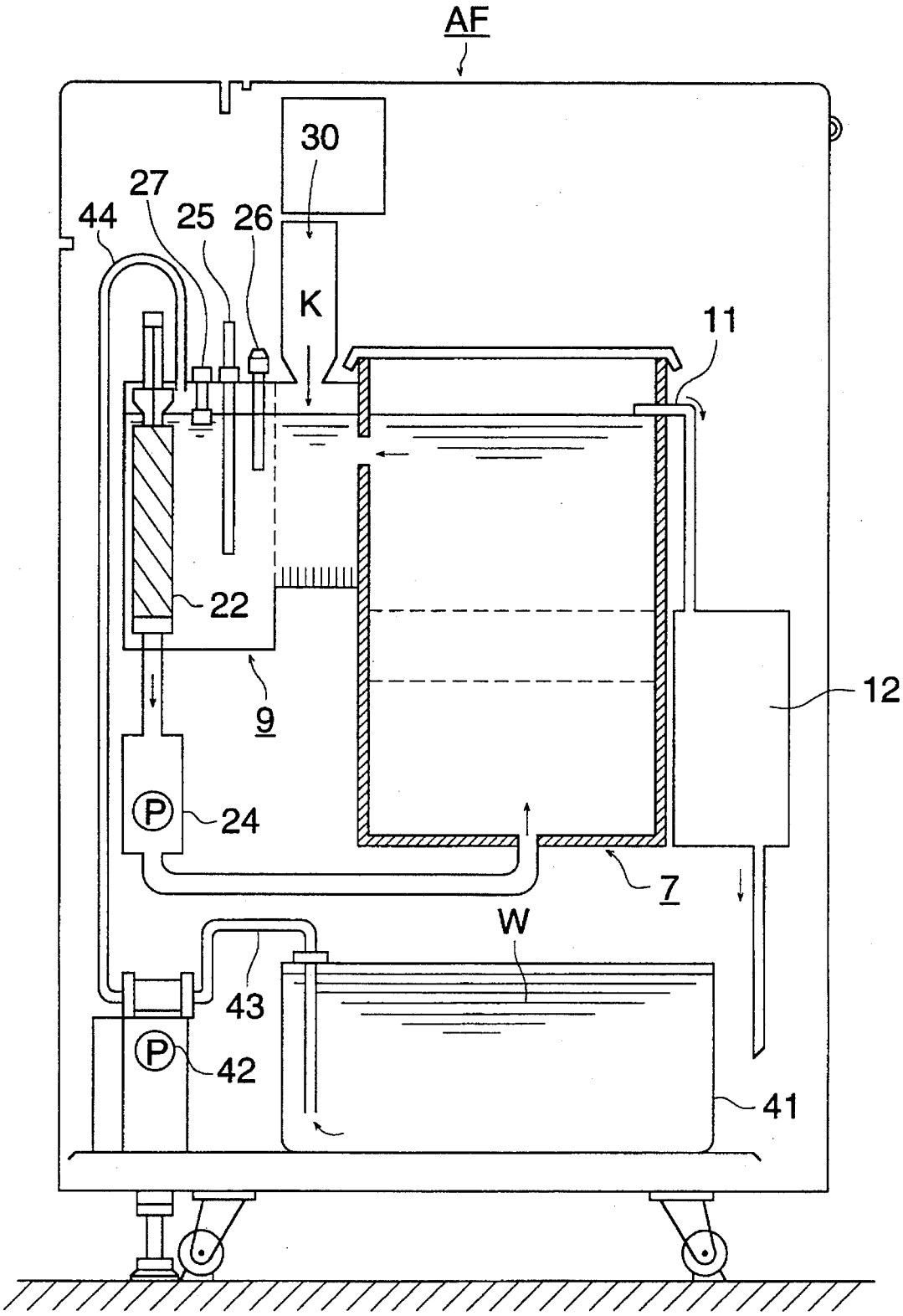
FIG. 5 is a sectional side view of the automatic developing apparatus for developing negative photographic film.

FIG. 4 is an overall arrangement view showing the front of the color negative film automatic developing apparatus AF to which the present invention is applied. FIG. 5 is a sectional side view of the automatic developing apparatus AF. The automatic developing apparatus AF is composed substantially of 4 processing solution tanks including a color developing tank 7A, bleaching tank 7B, fixing tanks 7C, 7D and stabilizing tanks 7E, 7F, 7G.

The processing solution tanks 7A, 7B, 7D, 7G are respectively communicated with the dissolution tanks 9A, 9B, 9D, 9G, and the processing solutions are circulated and stirred by the circulation pumps 24A, 24B, 24D, 24G. The aforementioned solid processing agent replenishment apparatus 8A, 8B, 8D, 8G are respectively attached onto the dissolution tanks 9A, 9B, 9D, 9D. An appropriate amount of solid processing agent is supplied by each solid processing agent replenishment apparatus. In this connection, reference numerals 9C, 9E, 9F are circulation tanks.

Replenishment water W provided in a common replenishment water tank 41 is supplied to the dissolution tanks 9A, 9B, 9D, 9G through the bellows pump 42, suction pipe 43 and water supply pipe 44.

In FIG. 4, one-dotted chain lines show the conveyance passages of the color photographic film f. The photographic film f is pulled out from a cartridge charged into the charging means. Then the photographic film f is processed in the color developing tank 7A, bleaching tank 7B, fixing tanks 7C, 7D and stabilizing tanks 7E, 7F, 7G. After the processing has been completed, the photographic film f is dried by a fan heater 61 provided in the drying section 6. Then the dried film is discharged outside of the apparatus.

In FIG. 5, numeral 12 is a waste solution tank for storing any solution that has overflowed, numeral 26 is a thermostat, and numeral 27 is a level sensor. In this connection, like reference characters are used to indicate like parts in FIGS. 3 and 5.

Figure 6:
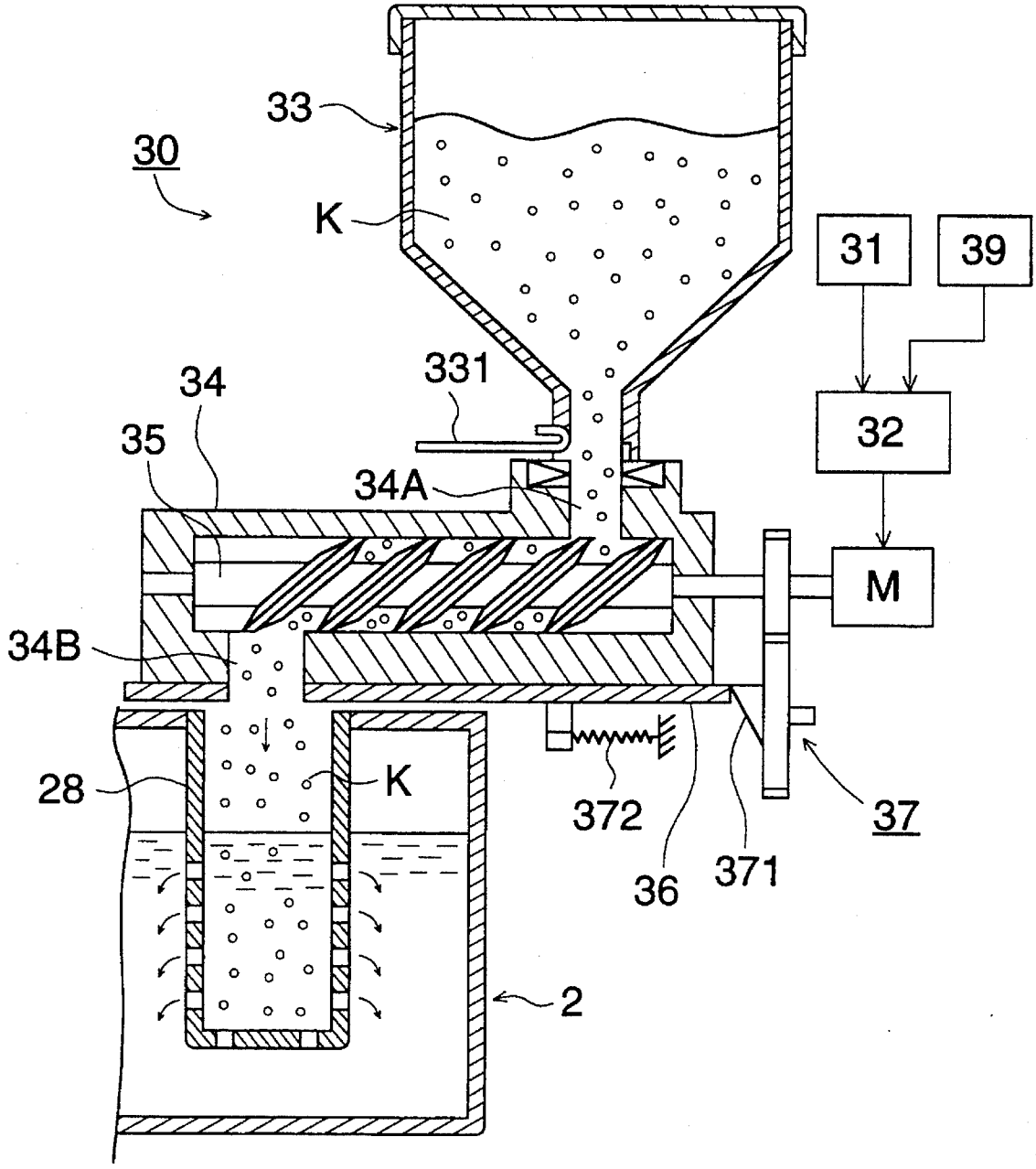
FIG. 6 is a sectional view of the solid processing agent supply means.

FIG. 6 is a sectional view showing the detail of the solid processing agent supply means 30.

In this example, a granular type, a powder type or a pellet type solid processing agent is used.

The solid processing agent supply means 30 includes: an accommodating container (cartridge) 33 for accommodating the granular type (powder type or pellet type) solid processing agent K, the accommodating container 33 being detachably provided; a replenishment apparatus 34 for receiving and supplying the solid processing agent K to the dissolution tank 2B by the action of the conveyance screw 35 which conveys the solid processing agent K from the receiving opening 34A to the discharge opening 34B; a shutter 36 for opening and closing the discharge opening 34B; and a drive means 37. The solid processing agent K, in which granules having the specific volume of 0.6 to 2.0 $cm^3/g$, the water content ratio of 0.1 to 15 wt %, the average particle size of 150 to 1500 μm, and the distribution of particle size of 150 to 1500 μm, are contained not less than 50 wt %, is accommodated in the accommodating container 33. When the solid processing agent K is not yet used, the outlet of the accommodating container 33 is airtightly closed with a seal 331. After the accommodating container 33 has been attached to the replenishment apparatus 34, the seal 331 is peeled off. Then the solid processing agent K is conveyed by the rotation of the conveyance screw driven by the drive means 37, so that the solid processing agent K is discharged through the discharge opening 34B and charged into the dissolution tank 2. The movable shutter 36 is provided at a position close to the discharge opening 34B. This shutter 36 is opened by the action of a cam 371 of the drive means 37 driven by the motor M. When this shutter 36 is opened, it resists the force of the spring 372. In this way, the solid processing agent K is charged into the dissolution tank. When the number of revolutions of the motor M is controlled, an amount of the solid processing agent K supplied in one operation is determined, so that a predetermined amount of the solid processing agent K can be supplied. In the accommodating container 33, one pre-assembled set of the solid processing agent K is accommodated, that is, 1000 $cm^3$ to 2000 $cm^3$ of the solid processing agent K is accommodated, and it is more preferable that 200 $cm^3$ to 1500 $cm^3$ of the solid processing agent K is accommodated in the accommodating container 33. A mesh-shaped enclosure 28 is disposed at a position below the discharge opening 34B of the replenishment apparatus 34 and above the dissolution tank 2B. The solid processing agent K charged by the solid processing agent supply means 30 is received by the mesh-shaped enclosure 28. The enclosure 28 is a filter member for temporarily storing the solid processing agent K. However, components of the solid processing agent K that have not yet dissolved or components that have not dissolved in the processing solution, may move into the dissolution tank 2B.

Figure 7:
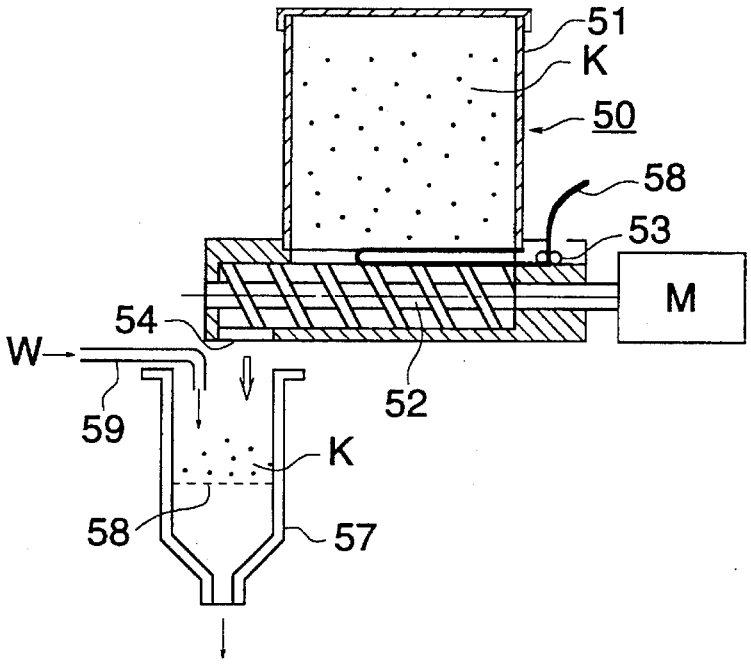
FIG. 7 is a sectional view of another example of the solid processing agent supply means. .

FIG. 7 is a sectional view of the screw type solid processing agent supply means 50 of another example of the present invention.

The supply apparatus 50 includes a package 51 in which the solid processing agent K is charged, and which is automatically opened by a roller 53. When the number of revolutions of the conveyance screw 52 is controlled, a predetermined amount of the solid processing agent K is supplied to the discharge section 54. Numeral 57 is a receiving means for receiving replenishment water W, numeral 58 is a filter member, and numeral 59 is a replenish water supply pipe for replenishing replenishment water W.

As described above, this supply means 50 has a function in which the package 51 is automatically opened. Therefore, even when the package 51 is opened and closed, fine powder is not scattered, preventing contamination of the working environment.

Figure 8:
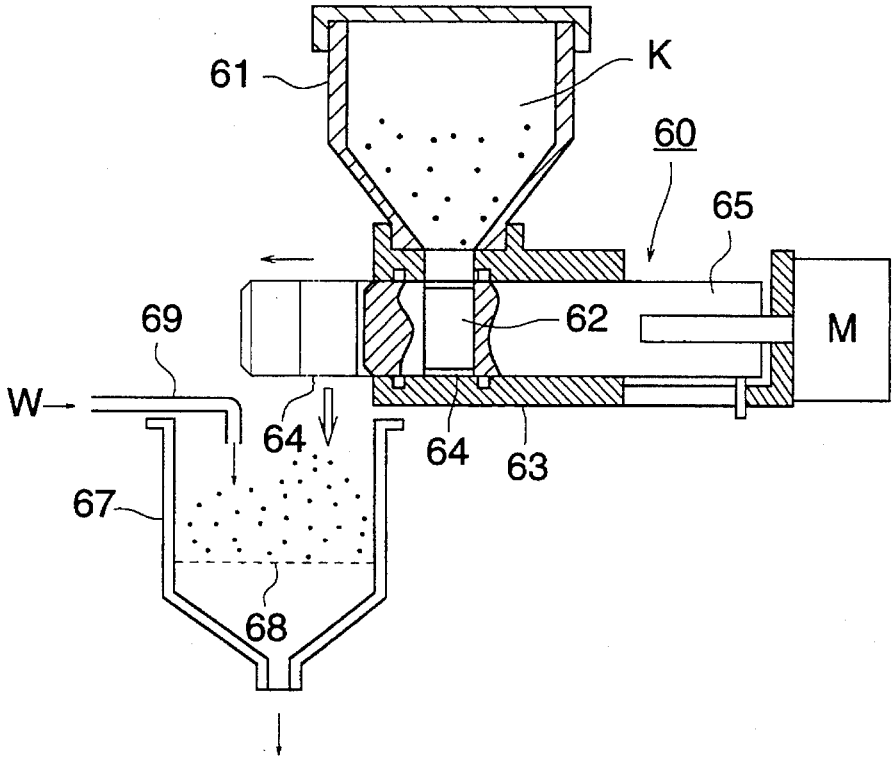
FIG. 8 is a sectional view of still another example of the solid processing agent supply means.

FIG. 8 is a sectional view of the sliding type solid processing agent supply means 60 of another example of the present invention. An accommodating chamber 61 in which the granular type solid processing agent K, having the above specific volume, water content ratio, average particle size, and particle size distribution, is accommodated is detachably attached to the replenishment apparatus 63. A piston 65 is driven being controlled in accordance with the throughput of photosensitive material. When the piston 65 is horizontally moved to the right, a predetermined amount of the solid processing agent K is put into a measuring hole 62. When the piston 65 is moved oppositely to the left, the predetermined amount of the solid processing agent K is supplied to the receiving means 67 through a discharging section 64. In a lower portion of the discharging section 64, there are provided a receiving means 67, a filter member 68 and a replenishment water supply pipe 69 for replenishing water W.

Figure 9:
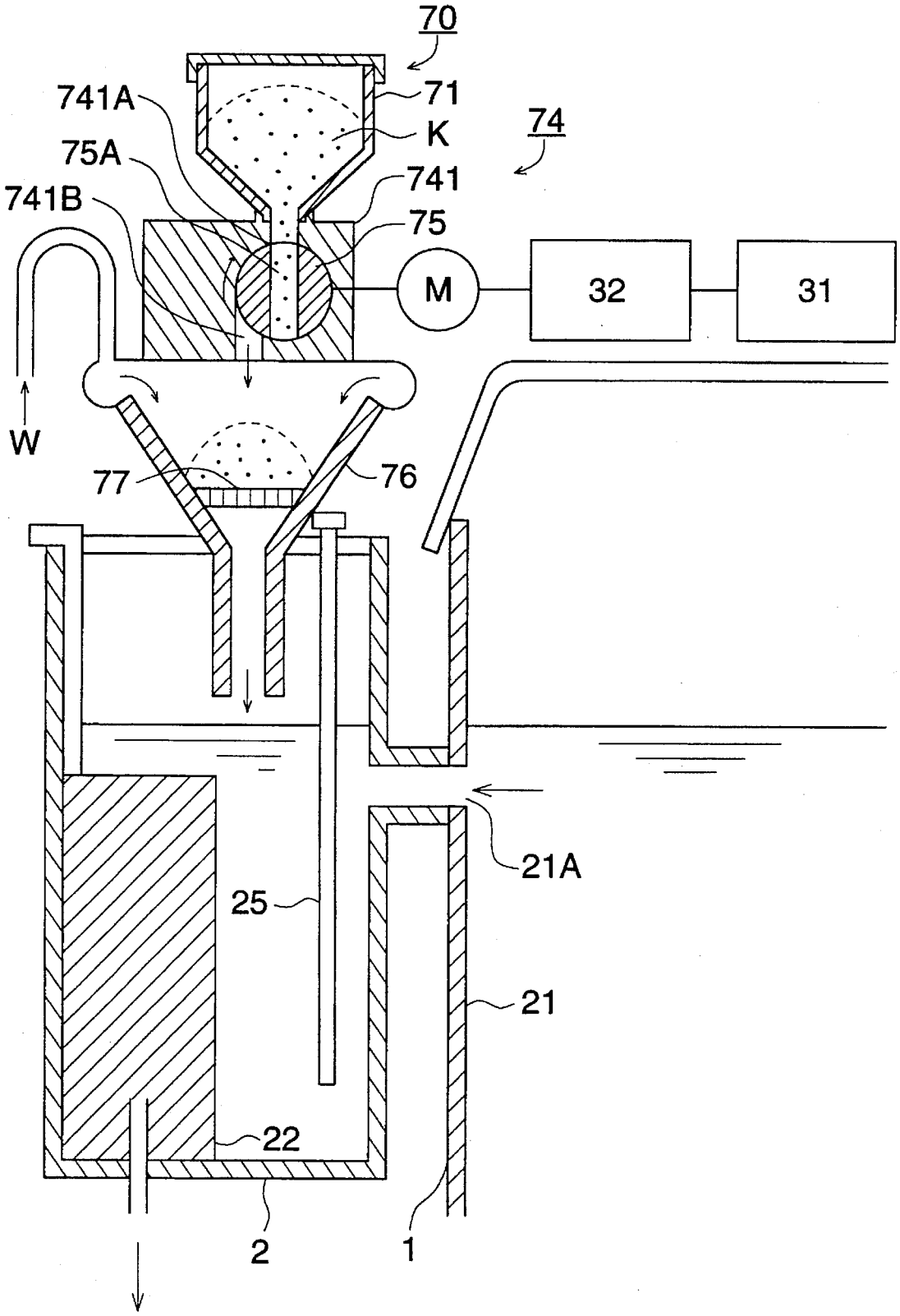
FIG. 9 is a sectional view of still one more example of the solid processing agent supply means.

FIG. 9 is a sectional view of the rotor type solid processing agent supply means 70 of another example of the present invention.

An accommodating container 71 in which the granular type (or powder type, or pellet type) solid processing agent K, having the above specific volume, water content ratio, average particle size, and particle size distribution, is accommodated is detachably attached to an upper portion of the replenishment apparatus 74. A fixed main body 741 of the replenishment apparatus 74 includes a receiving opening 741A, a discharge opening 741B, and a cylindrical cavity portion in which the rotational conveyance member (rotor) 75 is slidably rotated. The rotational conveyance member (rotor) 75 is provided with a measuring hole 75A by which a predetermined amount of solid processing agent K is received and conveyed. When the conveyance member 75 is rotated, the solid processing agent K accommodated in the accommodating container 71 is introduced from the receiving opening 741A and a predetermined amount of the solid processing agent is measured by the measuring hole 75A. After this, the measured solid processing agent is charged into the dissolution tank 2 from the discharge opening 741B. Numeral 76 is a receiving means arranged in an upper portion of the dissolution tank 2. The receiving means 76 receives the solid processing agent K supplied from the upper portion and also receives replenishment water W. The solid processing agent K and replenishment water W pass through the filter member 77, and are charged into the processing solution in the dissolution tank 2.

Figure 10:
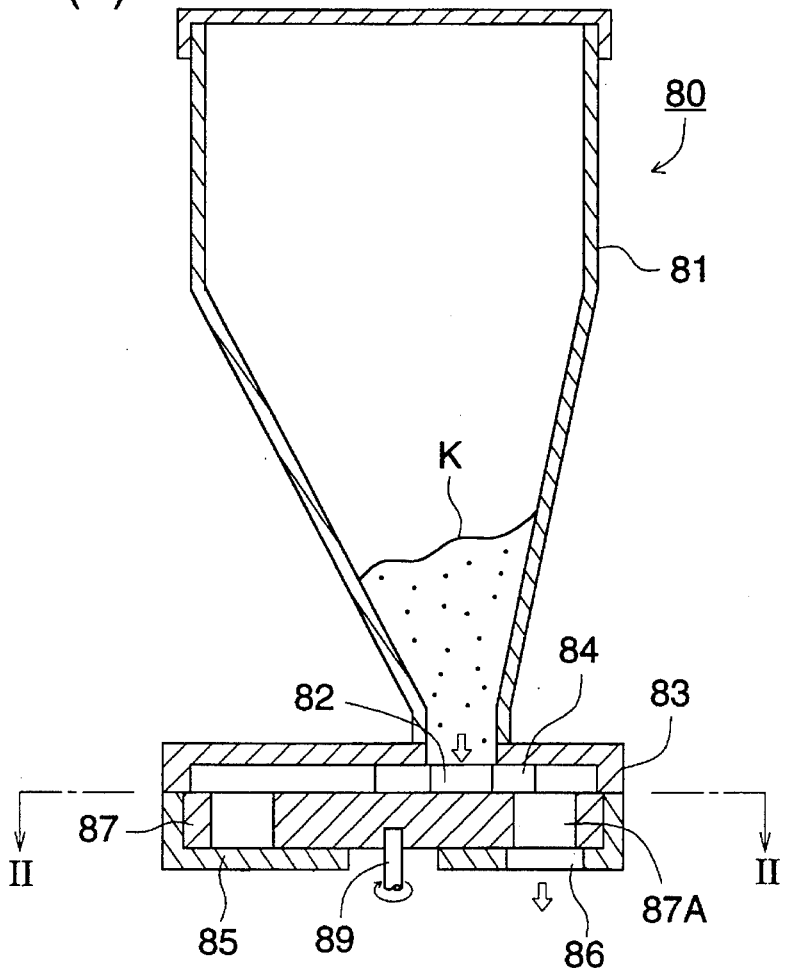
FIGS. 10(A) and 10(B) are sectional views of the solid processing agent replenishment apparatus having a measuring means which is applicable to the present invention.
Figure 10:
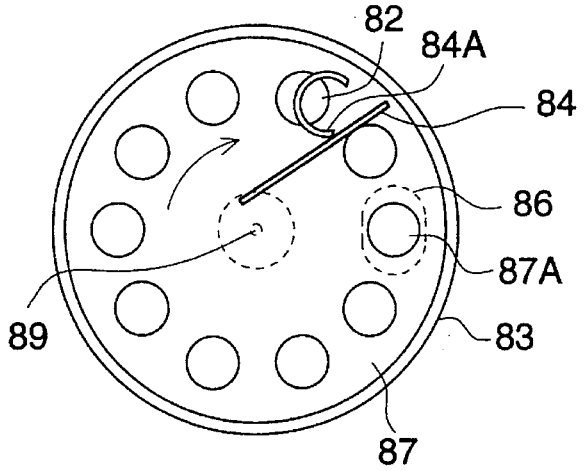

FIG. 10(A) is a vertical sectional view of the solid processing agent replenishment apparatus 80 having a rotational disk type measuring means which is applicable to the present invention. FIG. 10(B) is a horizontal sectional view taken on line II—II in FIG. 10(A). In these drawings, numeral 81 is a hopper in which the granular or powdery solid processing agent K is accommodated, numeral 82 is a supply opening which corresponds to the lower end exit of the hopper 81. Numeral 83 is a hopper base which is a cover of the upper surface of a measuring housing 85, and the hopper 81 and a scraper 84 are fixed to the hopper base 83. A discharge opening 86 is provided on the bottom portion of the measuring housing 85. A drive shaft 89, which is connected to a drive source, protrudes upward from an opening provided on the surface of the central portion of the measuring housing 85, and a measuring disk 87 is connected to the drive shaft 89. A total of ten measuring holes 87A are provided on the measuring disk 87 at positions where the circumference, having the same radius as the radius of rotation of the delivery opening 86, is divided into 10, that is, ten measuring holes 87A are provided on the measuring disk 87 at every 36°.

The solid processing agent K in the hopper 81 is supplied inside a bending plate portion 84A of the scraper 84 located at the upstream side of the delivery opening 86, through the supply opening 82.

Next, when the measuring disk 87 is horizontally rotated, the measuring hole 87A is filled with the solid processing agent K supplied from the hopper 81, and the excess agent outside the hole is scraped off by the scraper 84. Then, a predetermined amount of solid processing agent K, with which the measuring hole 87A has been filled, is conveyed, and dropped through the delivery opening 86 into the lower dissolving tank, not shown in the drawing.

Figure 11:
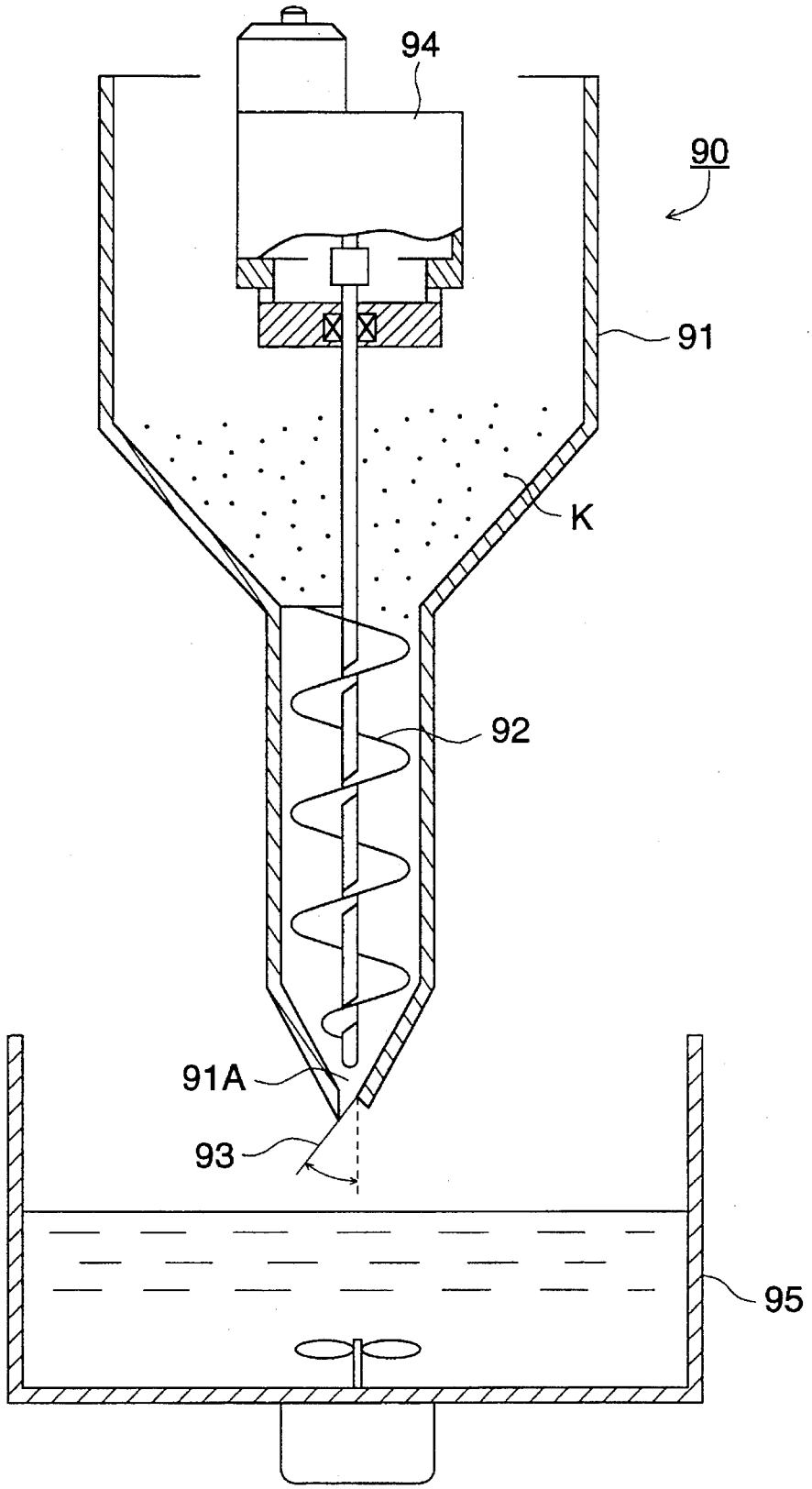
FIG. 11 is a sectional view of another example of the measuring means.

FIG. 11 is a sectional view showing another example of the solid processing agent replenishment apparatus having a measuring means applicable to the present invention. The replenishment apparatus 90 can easily adjust the amount of solid processing agent K to be supplied from a hopper 91 by the number of rotations of a spiral screw 92 rotated by a motor 94. Further, when a movable cover 93 is provided at the end portion of a delivery opening 91A, the intrusion of gases generated from the processing solution in the processing tank 95 can be prevented.

Figure 12:
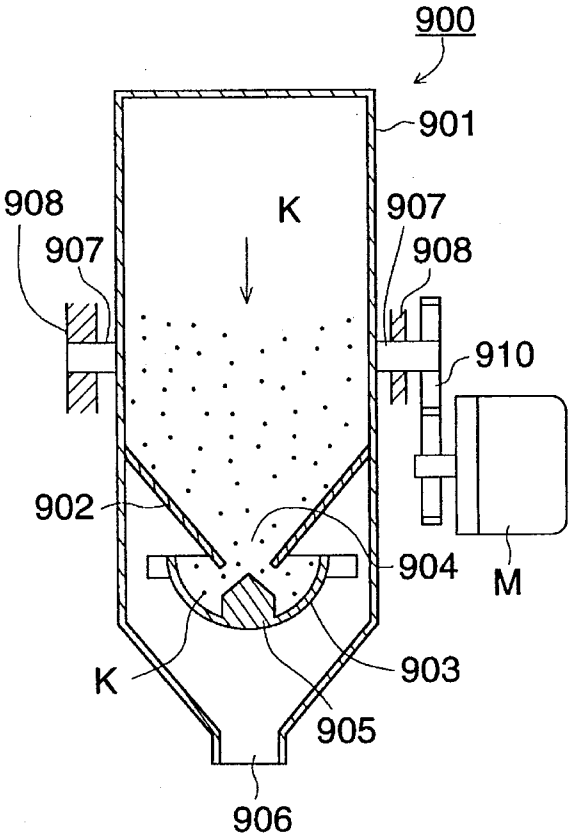
FIGS. 12(A), 12(B) and 12(C) are sectional views of still another example of the measuring means.
Figure 12:
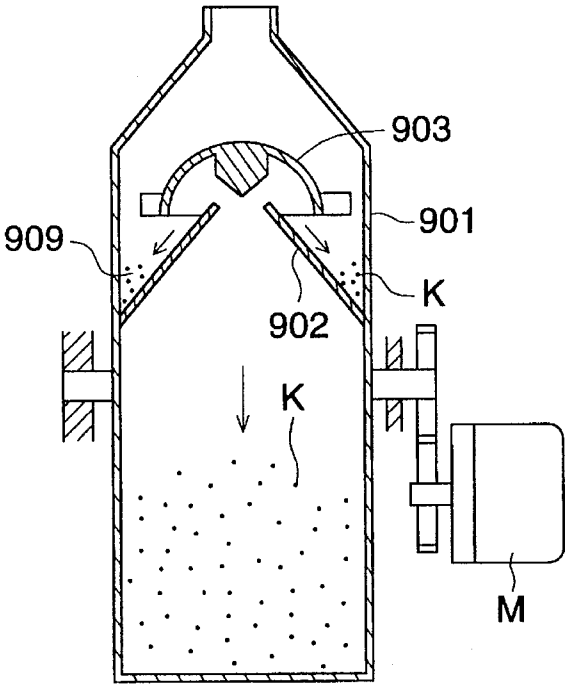
Figure 12:
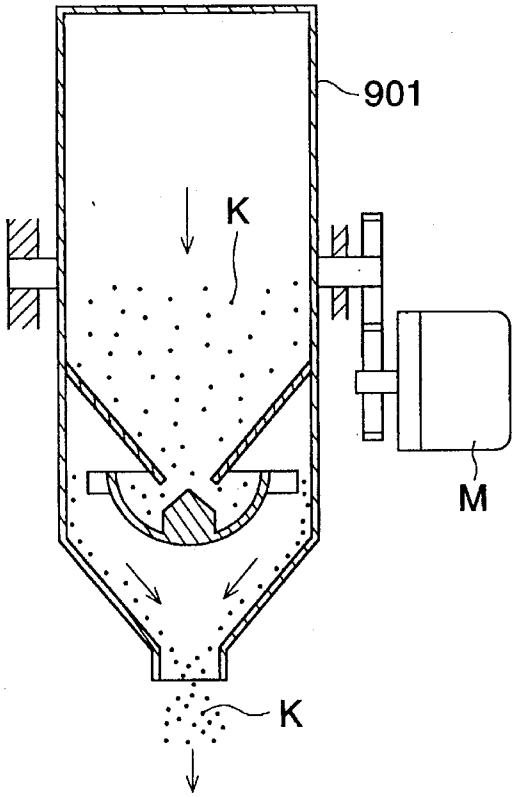

FIG. 12 is a sectional view showing still another example of the solid processing agent replenishment apparatus having a measuring means applicable to the present invention.

In a solid processing agent replenishment apparatus 900, a funnel 902 for guiding the solid processing agent K, which is granules or powders, when the container main body 901 is upended, and a determination dish 903 which is provided above the funnel and temporarily receives the solid processing agent K, are provided in the container main body 901. A protrusion for counter-flow prevention 905 is provided in the determination dish 903 opposite to the exit portion 904 of the funnel 902. Numeral 906 is a delivery opening of the container main body. A support shaft 907 is integrally provided with the container main body inside the outer wall of the container main body 901. The rotatable support shaft 907 is supported by a bearing 908. One end of the support shaft 907 is connected to the drive source M through a transmission means 910 such as gears or the like. When the drive source M rotates, the container main body is rotated once from the reverse position shown in FIG. 12(A) to the same reversed position shown in FIG. 12(C) through a normal position shown in FIG. 12(B), and then the rotation of the container main body is stopped.

When the container main body 901 is upended, the solid processing agent K drops through the exit portion 904 of the funnel 902 into the determination dish 903 as shown in FIG. 12(A), and when the exit portion 904 is filled with the processing agent K, dropping of the processing agent K is stopped.

Then, the container main body 901 is returned to the normal position as shown in FIG. 12(B), the solid processing agent K above the protrusion 905 is returned to the inside of the container main body 901. On the other hand, the solid processing agent K collected and measured on the determination dish 903, does not flow from the exit portion 904 to the container main body 901 because the protrusion 905 is provided on the determination dish 903. In this case, the solid processing agent K slidably drops along the outer conical surface of the funnel 902, and is collected in a ring-shaped recess portion 909 around the lower portion of the outer conical surface.

Next, the container main body 901 is upended again as shown in FIG. 12(C), the solid processing agent K drops from the delivery opening 906. At the same time, as explained in FIG. 12(A), a predetermined amount of the solid processing agent K is measured. As described above, when the container main body is repeatedly rotated, a predetermined amount of the solid processing agent K is successively measured and supplied.

Figure 13:
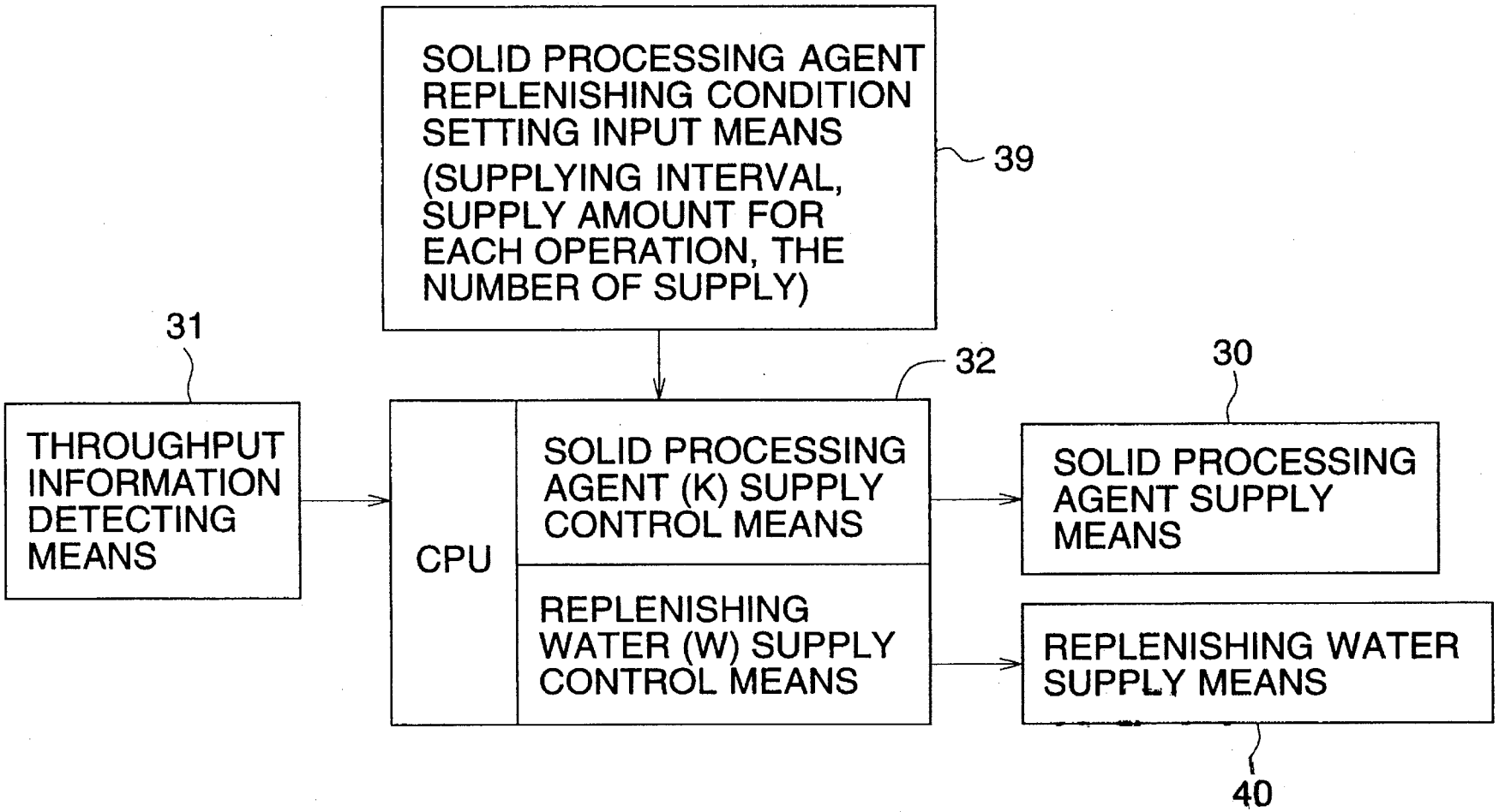
FIG. 13 is a block diagram of supply control for controlling the solid processing agent and replenishment water.

FIG. 13 is a block diagram showing the controlling of the supply of the solid processing agent and replenishment water. When throughput information of the photosensitive material (photographic paper P), sent to the automatic developing apparatus AP, is detected by the detection means 31 and sent to the supply control means 32, a predetermined amount of the solid processing agent K and replenishment water W is replenished into the dissolving tank 2 by supplying means 30 and 40. The solid processing agent K and replenishment water are intermittently replenished by a plurality of times ($k_1$-$k_n$), every time when the signal is generated by the detection means 31.

In the above supply control, predetermined setting values, that is, the charging time interval and the charging amount for each time, are set for each replenishment agent by the solid processing agent replenishment condition setting input means 39, and are inputted into the supply control means 32.

When completion of delivery of the solid processing agent K remaining in the accommodating container 33 (51, 61, 71) is detected by the residual agent detection means of the solid processing agent K, the replenishment for one set of the accommodating container 33 is completed.

As described above, after the entire amount of the solid processing agent in the accommodating container 33 (51, 61, 71) has been delivered, an alarm for replacing the accommodating container is generated, and the container replacement operation is carried out.

In the above example, the explanation of the present invention is made under the condition that the automatic developing apparatus AP includes the color development tank 1A, bleaching and fixing tank 1B and stabilizing tanks 1C, 1D, 1E, wherein these tanks compose substantially a processing tank 1. However, it should be noted that the present invention is not limited to the specific example. The present invention can be applied to an automatic developing apparatus having four tanks consisting of a color developing tank 7A, a bleaching tank 7B, fixing tanks 7C, 7D, and stabilizing tanks 7E, 7F, 7G. Further, the replenishment apparatus for granular solid processing agent K in the accommodating container of the present invention can be applied to an automatic developing apparatus AP for processing color negative film, having more processing solution tanks than those described above.

As the solid processing agent according to the present invention, the granular solid processing agent for color paper was prepared by almost the same manufacturing method as that disclosed in Japanese Patent Publication Open to Public Inspection No. 109042/1990.

One package unit of the above solid processing agent, that is, a charging amount for each operation is shown below.

TABLE 2

| | Charging amount for each operation | Throughput of color paper for each charge |
|---|---|---|
| Color development replenishment agent | 9 g | 1 $m^2$ |
| Bleaching and fixing replenishment agent | 23 g | 1 $m^2$ |
| Stabilizing replenishment agent | 1.6 g | 1 $m^2$ |

Konica color QA paper-type A6 (produced by Konica Corporation) of 8 $m^2$ was processed per day, and Konica color QA paper-type A6 of 240 $m^2$ was processed in total under the condition of environmental temperature of 25° C., and humidity of 80%.

In this case, physical properties of the granular agents for the color development agent were changed by conditions of drying time, the mesh of the grading machine, a sieve, etc., and are shown in Table 3 as follows.

decrease of development processing fluctuation, and discoloring of the processing solution.

As explained above, the automatic developing apparatus having the replenishment apparatus for solid processing agents for developing silver halide photographic photosensitive material of the present invention can provide the following effects.

(1) Even when deviations of shape, volume, weight and composition of the solid processing agent are caused by the influence of environmental humidity or vibration during transportation, errors in the replenishment amount do not occur.

(2) It is not necessary to provide a complicated and precise replenishment apparatus, and accurate replenishing operations can be carried out by an inexpensive replenishment apparatus.

(3) There is no precipitation in the processing tank, so that the filter is not stopped up. Accordingly, the replenishment solution is stably circulated in the filter section, and processing can be carried out uniformly.

What is claimed is:

1. An apparatus for processing a silver halide photographic material comprising:

a processing tank in which a processing solution is stored; and an agent supplier for measuring a predetermined volume of a solid processing agent and for supplying said predetermined volume to the processing solution, wherein the solid processing agent comprises a mixture of a plurality of processing agent components, more than 50% of the components having average particle sizes of 150 μm to 3000 μm and said components having a specific volume of 0.6 $cm^3/g$ to 2.0 $cm^3/g$.

2. The apparatus of claim 1, wherein a shape of the processing solid agent is one of granular, powder and pill.

3. The apparatus of claim 1, wherein the agent supply means supplies the predetermined volume of the processing agent in the processing tank.

4. The apparatus of claim 1, wherein the processing tank comprises a receiving section which communicates with the

TABLE 3

| | Average particle size (μm) | Ratio of granules having particle size of 150–3000 μm (%) | Specific volume $cm^3/g$ | Water content ratio (%) | Blocking | *Development process-ability | **Colored tar in processing solution | Remark |
|---|---|---|---|---|---|---|---|---|
| 1 | 120 | 30 | 1.0 | 1.0 | Yes | 0.19 | X | Other inventions |
| 2 | 150 | 50 | 1.0 | 1.0 | No | 0.04 | O | Present invention |
| 3 | 300 | 70 | 1.2 | 1.0 | No | 0.03 | O | Present invention |
| 4 | 500 | 90 | 1.2 | 1.0 | No | 0.01 | O | Present invention |
| 5 | 1000 | 70 | 1.2 | 1.0 | No | 0.02 | O | Present invention |
| 6 | 3000 | 50 | 1.4 | 1.0 | No | 0.04 | O | Present invention |
| 7 | 3500 | 30 | 1.4 | 1.0 | Yes | 0.14 | X | Other inventions |
| 8 | 500 | 90 | 0.5 | 1.0 | No | 0.06 | O – Δ | Present invention |
| 9 | 500 | 90 | 0.6 | 1.0 | No | 0.04 | O | Present invention |
| 10 | 500 | 90 | 0.8 | 1.0 | No | 0.03 | O | Present invention |
| 11 | 500 | 90 | 1.5 | 1.0 | No | 0.02 | O | Present invention |
| 12 | 500 | 90 | 2.0 | 1.0 | No | 0.04 | O | Present invention |
| 13 | 500 | 90 | 2.2 | 1.0 | No | 0.16 | O | Other inventions |
| 14 | 500 | 90 | 1.2 | 0.05 | No | 0.12 | O | Other inventions |
| 15 | 500 | 90 | 1.2 | 0.1 | No | 0.04 | O | Present inventions |
| 16 | 500 | 90 | 1.2 | 0.3 | No | 0.02 | O | Present inventions |
| 17 | 500 | 90 | 1.2 | 10 | No | 0.04 | O | Present inventions |
| 18 | 500 | 90 | 1.2 | 20 | No | 0.06 | O – Δ | Other inventions |

*The development processability shows the following: the photosensitive material was processed for each 5 $m^2$ by the processing agent of Konica color QA paper control matrix, and the difference of density of the HD portion when the photosensitive material of 160 $m^2$ was processed in total is shown in Table 3.

**O No colored tar Δ Colored X Existence of tar

When granules having the particle size of the present invention were used, no blocking occurred, and fluctuation in the development processability was small. Accordingly, it was found that the charging stability was higher. When granules having the particle size of other inventions were used, blocking occurred, and development fluctuation was larger. Further, it was found that coloring was larger, and tar was generated. Further, when the specific volume and the water content ratio are within the preferable range, it was found that the present invention was advantageous to the processing tank so that the processing solution circulates between the receiving section and the processing tank, wherein the agent supply means supplies the predetermined volume of the processing agent in the receiving section.

5. The apparatus of claim 4, further comprising water supply means for supplying water in the processing solution at one of the processing tank and the receiving section.

6. The apparatus of claim 1, further comprising control means for controlling the agent supply means in accordance with a processing amount of the silver halide photographic material.

7. The apparatus of claim 1, wherein said average particle sizes are 150 μm to 1500 μm.

8. The apparatus of claim 1, wherein the solid processing agent has a bulk density of 1.0 $g/cm^3$ to 2.5 $g/cm^3$.

9. The apparatus of claim 1, wherein the solid processing agent has a bulk density of 0.4 $g/cm^3$ to 0.95 $g/cm^3$.

10. The apparatus of claim 1, wherein the solid processing agent has water content of 0.1 weight % to 15.0 weight %.

* * * * *